US010981767B1

(12) United States Patent
Luo

(10) Patent No.: US 10,981,767 B1
(45) Date of Patent: Apr. 20, 2021

(54) EDGE-BREAKING CAN OPENER

(71) Applicant: Gongping Luo, Huizhou (CN)

(72) Inventor: Gongping Luo, Huizhou (CN)

( * ) Notice: Subject to any disclaimer, the term of this patent is extended or adjusted under 35 U.S.C. 154(b) by 0 days.

(21) Appl. No.: 16/980,306

(22) PCT Filed: Nov. 30, 2019

(86) PCT No.: PCT/CN2019/122278

§ 371 (c)(1),
(2) Date: Sep. 11, 2020

(30) Foreign Application Priority Data

Nov. 29, 2019 (CN) ..... 201911205898.5

(51) Int. Cl.
*B67B 7/70* (2006.01)
*B67B 7/46* (2006.01)

(52) U.S. Cl.
CPC ..... *B67B 7/34* (2013.01)

(58) Field of Classification Search
CPC ..... B67B 7/30; B67B 2007/303; B67B 7/32; B67B 7/34; B67B 7/36
See application file for complete search history.

(56) References Cited

U.S. PATENT DOCUMENTS 5,651,183 A 7/1997 Cincotta et al.
6,058,613 A * 5/2000 So ..... B67B 7/34 30/418
7,587,831 B2 * 9/2009 So ..... B67B 7/32 30/416
7,784,190 B2 * 8/2010 So ..... B67B 7/32 30/416
2006/0101652 A1 * 5/2006 So ..... B67B 7/34 30/418
2014/0290077 A1 10/2014 Paulson
2016/0368750 A1 * 12/2016 Kalogroulis ..... B67B 7/44

FOREIGN PATENT DOCUMENTS

CN 2111948 U 8/1992
CN 2118067 U 10/1992
CN 1772593 A 5/2006
CN 100560472 C 11/2009
DE 202004007523 U1 10/2005

* cited by examiner

*Primary Examiner* — Stephen Choi
(74) *Attorney, Agent, or Firm* — Muncy, Geissler, Olds & Lowe, P.C.

(57) ABSTRACT

An edge-breaking can opener includes a first clamping handle and a second clamping handle. The first clamping handle and the second clamping handle are rotatably connected by using a rivet. A round angle is set between a tray gear and a helical gear, which reduces a cutting height. A protrusion portion on an original cutter wheel is creatively changed to an elastically adjustable support wheel that acts on a can with different edge heights. It is convenient to perform occlusion during cutting, and a cut can cover can be directly and safely taken out, thereby preventing a hand from coming into contact with the can cover. The cutter wheel can easily perform cutting by using acting force of spring plate, which is suitable for cans with a certain material thickness.

6 Claims, 6 Drawing Sheets

EDGE-BREAKING CAN OPENER

CROSS REFERENCE TO RELATED APPLICATIONS

This application is the national phase entry of International Application No. PCT/CN2019/122278, filed on Nov. 30, 2019, which claims priority of Application No. 201911205898.5 filed in China on Nov. 29, 2019 under 35 U.S.C. § 119; the entire contents of both which are hereby incorporated by reference.

FIELD OF TECHNOLOGY

The present disclosure relates to the technical field of can openers, and in particular, to an edge-breaking can opener.

BACKGROUND

The edge-breaking can opener is a tool for performing cutting from an edge of a can cover. At present, such a type of can opener on the market includes a drive wheel and a cutting wheel that occlude each other for cutting. The drive wheel uses a combination of a rotating shaft and a gear disk. The gear disk includes a tray gear and a spur gear, and the three are riveted. The spur gear and the tray gear are disposed in a manner of being perpendicular to each other. Therefore, when a can cover is clamped and occluded, a location at which the drive wheel is located is relatively low. In this way, a location at which the cutting wheel cuts the can cover is correspondingly relatively deep. However, a protrusion portion (FIG. 10) is disposed on an existing cutting wheel, and the protrusion portion (FIG. 10) of the cutter wheel plays a role of clamping an edge when a can is opened. After the can cover is cut, due to the deep cutting location and the protrusion portion (FIG. 10) disposed on the cutter wheel, two clamping handles need to be first opened after the can is opened, to increase a gap between the cutting wheel and the drive wheel. Because the cutting location is relatively deep, a part of the can cover and the can body are tightly occluded after cutting, the can cover cannot be taken out by hand, and pliers need to be used to take out the can cover, which is neither hygienic nor safe. In addition, heights of the edge of the can cover are inconsistent, the protruding portion (FIG. 10) on the cutter wheel makes the cutter wheel incapable of cutting a can with an excessively high edge of the can cover. A traditional can opener performs rigid cutting. Because thicknesses of materials of cans are inconsistent, when a thin material is cut, a long distance between a cutter portion and the edge leads to continuous cutting or a failure to cut. When a thick material is cut, because the cutting wheel and the edge occlude too tightly, cutting force increases sharply or the cutting cannot be performed. All the above cases bring great confusion and inconvenience to consumers.

SUMMARY

An objective of the present disclosure is to provide a type of edge-breaking can opener for which a hand comes into no contact with a can cover, and the can cover can be directly and conveniently removed after the can cover is cut. The edge-breaking can opener is safe and hygienic, and can improve cutting quality and adapt to various types of cans.

To resolve the foregoing technical problems, the present disclosure may be implemented by using the following technical solutions:

An edge-breaking can opener is provided, including a first clamping handle and a second clamping handle, the first clamping handle and the second clamping handle being connected through relative rotation by using a rivet, where a cutting wheel and a limiting groove are disposed on the first clamping handle, a drive wheel is disposed on the second clamping handle, the drive wheel and the cutting wheel are capable of occluding each other through the limiting groove, the cutting wheel includes a fixing shaft, a cutter wheel, a support wheel, and a round cover, an end of the fixing shaft is aslant disposed on the first clamping handle, the round cover, the support wheel, and the cutter wheel are separately sleeved on the fixing shaft from up to bottom, an elastic piece is disposed between the round cover and the support wheel, the cutter wheel is provided with a stepped groove, a spring plate is disposed in the stepped groove, the spring plate is sleeved on the fixing shaft, and the spring plate is provided with an opening.

Further, the drive wheel includes an integrally formed gear disk and a rotating shaft, the gear disk is connected to one end of the rotating shaft, the rotating shaft is further provided with a straight groove, the straight groove is provided with a card, the gear disk includes a tray gear and a helical gear, the tray gear and the helical gear are aslant disposed, and a round angle is provided between the tray gear and the helical gear.

Further, the cutter wheel includes an integrally formed rotating portion and a cutter portion protruding outwards, the cutter portion is disposed at a lower portion of the cutter wheel, a boss portion protruding outwards is disposed on the support wheel, and the boss portion is disposed at a lower portion of the support wheel.

Further, the cutting wheel further includes a cutter wheel washer and a gear washer, the cutter wheel washer is sleeved on the fixing shaft, and is disposed between the cutter wheel and the first clamping handle, a spring plate stopper is disposed on a surface, of the cutter wheel washer, adjacent to the cutter wheel, the spring plate stopper cooperates with the opening, a fixing block for fixing is disposed on the other surface of the cutter wheel washer, and the gear washer is sleeved on the fixing shaft, and is disposed above the cutter wheel and inside the support wheel.

Further, a fixing sleeve is further disposed on the second clamping handle, a step protruding outwards and an oblique groove are separately disposed on the fixing sleeve, a rivet sleeve is disposed in the oblique groove, the fixing sleeve is disposed on the second clamping handle by passing through the step and the rivet sleeve, the rotating shaft passes through the fixing sleeve by using the gear disk and the card, a surface cover further covers the fixing sleeve, the surface cover is disposed between the gear disk and the first clamping handle, and a knob handle is further disposed at the other end of the rotating shaft.

Further, the cutter wheel uses a 1.4116 (German brand number) stainless steel material, the drive wheel, the cutter wheel washer, the gear washer, and the fixing sleeve are all made of a 420J2 stainless steel material, and the round cover is made of a 304 stainless steel material.

The present disclosure has the following beneficial effects:

First, a cover can be directly taken out after a can is opened. By disposing the tray gear and the helical gear in an inclined manner, and based on the round angle between the tray gear and the helical gear, a location at which the cutter wheel in the cutting wheel performs cutting is changed to reduce an overall cutting height of an edge of the can cover. In addition, a protrusion portion on the cutter wheel is changed to an elastically adjustable boss portion, and the edge of the can cover is directly clamped when the can is opened by using the boss portion of the support wheel, so that the can opener conveniently occludes the can. After opening the can is completed, the can cover is clamped by using a cutter portion of the cutter wheel and the tray gear. When the can cover is lifted up, the boss portion of the support wheel under an action of elasticity gradually leaves the edge on a can body. The can cover can be directly removed. After the removal, the first clamping handle and the second clamping handle are opened, and the can cover is placed at a corresponding location, to achieve a purpose of directly taking out the can cover after the can is opened. In this method, direct contact between a hand and the can cover is avoided, which is safe, hygienic, simple, and convenient.

Second, a can of a certain thickness can be cut. Because the spring plate is disposed in the cutter wheel of the cutting wheel, elastic force of the spring plate acts on the cutter wheel, so that the edge of the can cover can be directly cut. In this way, a cutting range of thick can materials is expanded.

Third, an edge of a can cover with different heights can be cut. Because the fixed protrusion portion on the cutter wheel is changed to the elastically adjustable boss portion, the boss portion of the support wheel is adjusted by using the elastic piece, so as to adapt to the different heights. When the can cover is occluded, the edge of the can cover can still be occluded even though the boss portion blocks the edge, and the edge of the can cover with the different heights can be cut by adjusting a height of the boss portion.

Fourth, an overall design is reasonable, it is easy to ensure accuracy of a workpiece, costs are low, a service life is long, cutting quality is desirable and stable, and there are few or no burrs after cutting.

DESCRIPTION OF THE EMBODIMENTS

Figure 1:
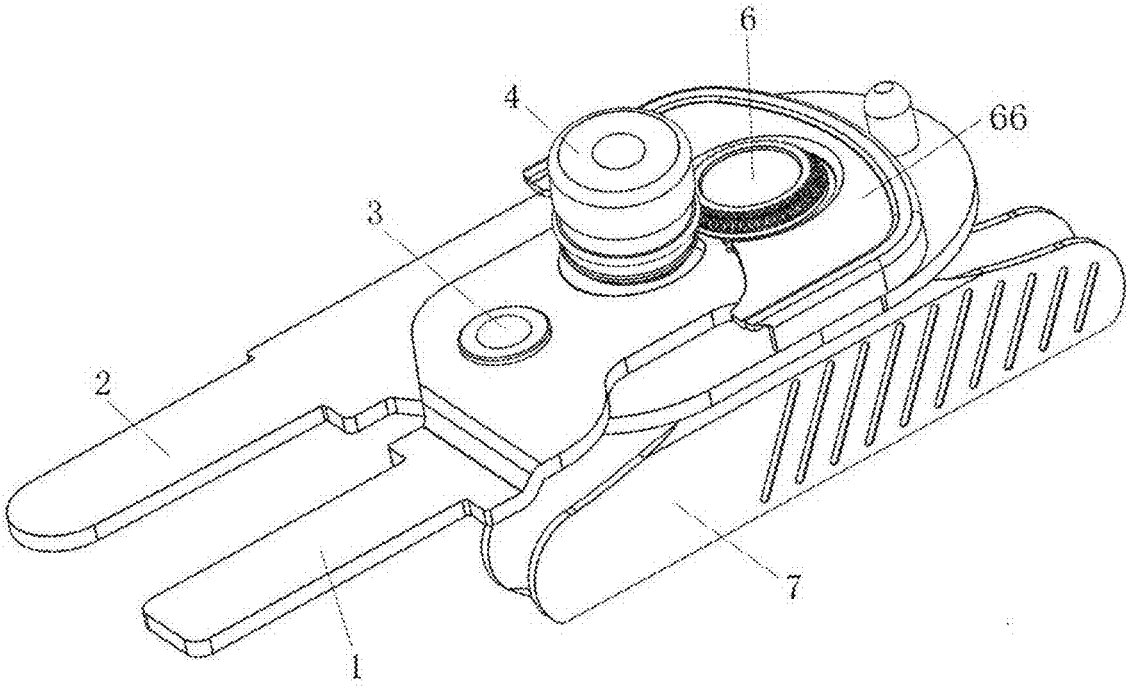
FIG. 1 is a schematic structural diagram 1 of an edge-breaking can opener according to the present disclosure.
Figure 2:
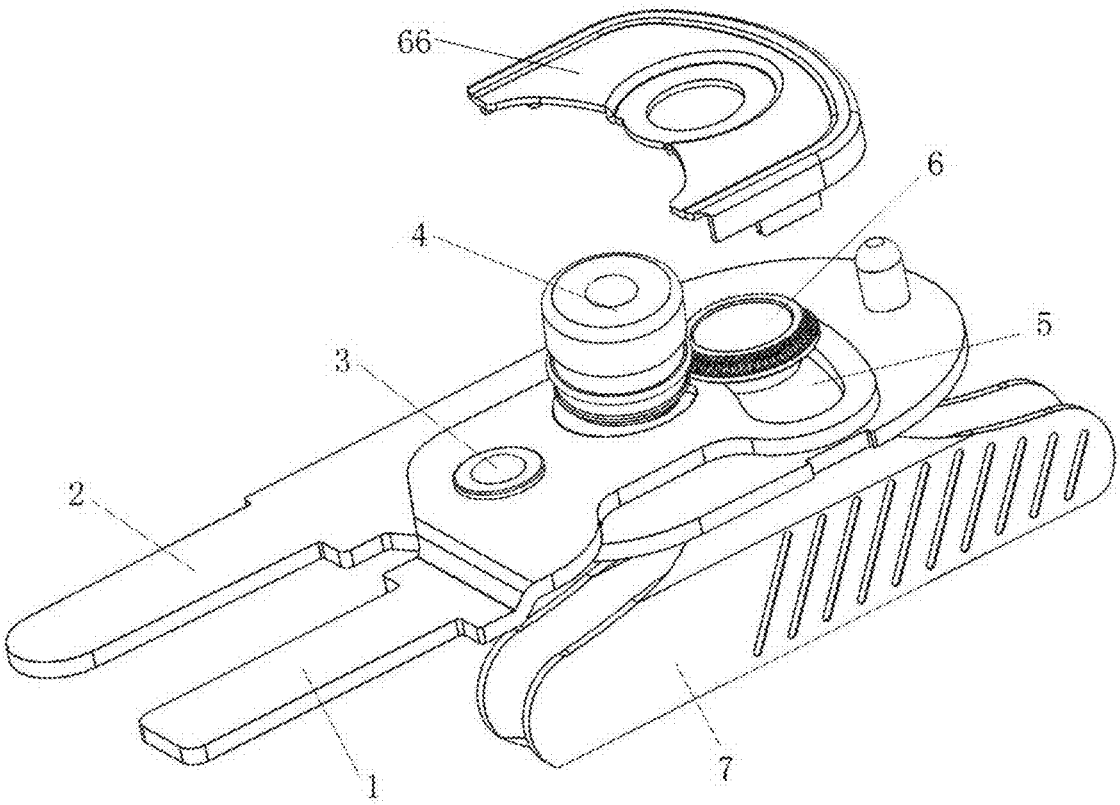
FIG. 2 is a schematic structural diagram 2 of an edge-breaking can opener according to the present disclosure.

To enable those skilled in the art to better understand the technical solutions of the present disclosure, the product of the present disclosure is further described in detail below with reference to the embodiments and the accompanying drawings.

As shown in FIG. 1 to FIG. 9. an edge-breaking can opener is provided, including a first clamping handle 1 and a second clamping handle 2, the first clamping handle 1 and the second clamping handle 2 being connected through relative rotation by using a rivet 3, where a cutting wheel 4 and a limiting groove 5 are disposed on the first clamping handle 1, a drive wheel 6 is disposed on the second clamping handle 2, the drive wheel 6 and the cutting wheel 4 are capable of occluding each other through the limiting groove 5, the cutting wheel 4 includes a fixing shaft 41, a cutter wheel 42, a support wheel 43, and a round cover 44, an end of the fixing shaft 41 is aslant disposed on the first clamping handle 1, the round cover 44, the support wheel 43, and the cutter wheel 42 are separately sleeved on the fixing shaft 41 from up to bottom, an elastic piece 45 is disposed between the round cover 44 and the support wheel 43, the cutter wheel 42 is provided with a stepped groove 423, a spring plate 46 is disposed in the stepped groove 423, the spring plate 46 is sleeved on the fixing shaft 41, and the spring plate 46 is provided with an opening 461.

For the edge-breaking can opener in the present disclosure, when cover opening is performed on a can, the first clamping handle 1 and the second clamping handle 2 are opened, and the drive wheel 6 limits an opening range through the limiting groove 5. After an edge 201 of a can cover 200 is placed between the drive wheel 6 and the cutter wheel 42, the first clamping handle 1 and the second clamping handle 2 are closed. The drive wheel 6 and the cutting wheel 4 occlude each other, to occlude the edge 201 of the can cover 200, the drive wheel 6 acts on a top edge of the can cover 200, and the cutting wheel 4 acts on the edge 201 of the can cover 200. When a knob handle 7 is rotated, the drive wheel 6 rotates around the top edge of the can cover 200. During the rotation, the cutting wheel 4 is driven to perform cutting around the edge 201 of the can cover 200. After the cutting is completed, the cutting wheel 4 and the drive wheel 6 can occlude each other, to directly take out the cut can cover 200. When the drive wheel 6 is separated from the cutting wheel 4, the can cover 200 can directly drop without being taken out by using pliers or a hand. An existing can opener performs rigid cutting, and thicknesses of materials of cans are inconsistent, and when a thin material is cut, a long distance between the cutter wheel 42 and the edge 201 leads to continuous cutting or a failure to cut; when a thick material is cut, a rotating portion 422 and the edge 201 occluding too tightly leads to a sharp increase in cutting force or a failure to perform cutting. Therefore, the spring plate 46 is disposed in a stepped groove 421 of the cutter wheel 42. Because there is a movable gap between the cutter wheel 42 and the fixing shaft 41, and the gap is greater than 0.3 mm, the rotating portion 422 of the cutter wheel 42 can always come into contact with the edge 201 by means of elastic force of the spring plate 46. When a thin material is cut, the cutter wheel 42 is enabled to approach the edge 201 by using the spring plate 46, and always act on the edge 201 to cut the edge 201. When a thick material is cut, and the cutter wheel 42 is enabled to act on the edge 201 by using the spring plate 46, no sharp increase in cutting force is caused, so that force used during cutting is made lighter and stable by using the spring plate 46, thereby improving cutting quality. When the edge 201 is cut, due to different heights of the edge 201, a height between the support wheel 43 and the cutter wheel 42 can be elastically adjusted by using the elastic piece 45. During a cutting process, the edge 201 of a can 100 can be conveniently and quickly clamped, and the can cover 200 can be directly removed after the cutting is completed.

Figure 6:
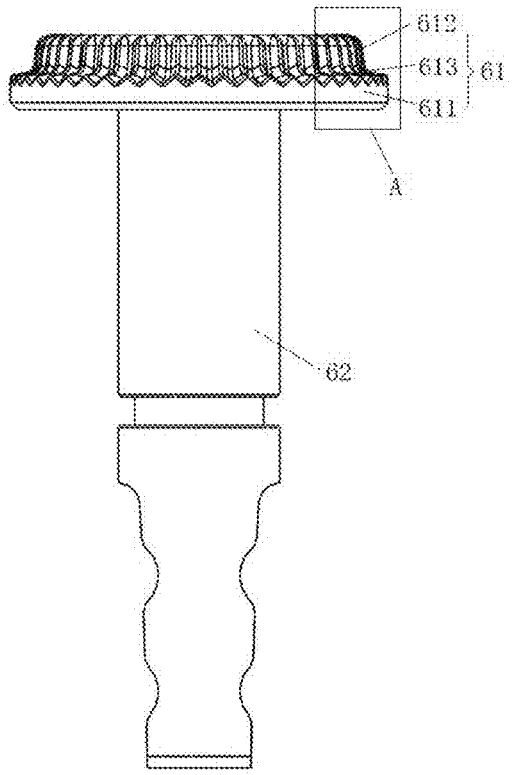
FIG. 6 is a schematic structural diagram of a drive wheel of an edge-breaking can opener according to the present disclosure.
Figure 7:
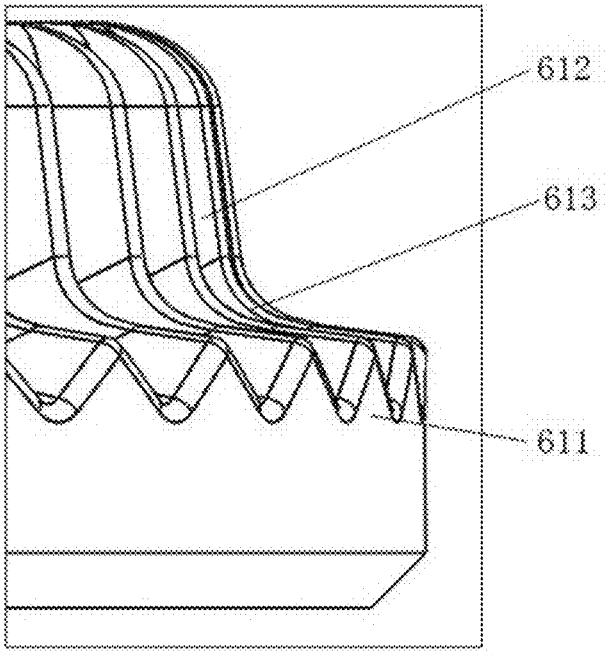
FIG. 7 is an enlarged view of a part A of an edge-breaking can opener in FIG. 6 according to the present disclosure.

As shown in FIG. 6 and FIG. 7, the drive wheel includes an integrally formed gear disk 61 and a rotating shaft 62, the rotating shaft 62 is further provided with a straight groove 621, the straight groove 621 is provided with a card 65, the gear disk 61 includes a tray gear 611 and a helical gear 612, the tray gear 611 and the helical gear 612 are aslant disposed, and a round angle 613 is provided between the tray gear and the helical gear.

Because the gear disk 61 of the existing can opener includes the tray gear 611 and a spur gear, and the tray gear 611 and the spur gear are disposed in a manner of being perpendicular to each other, when the cutting wheel 4 cuts the can cover 200, a cutting location is relatively deep, and a height for cutting the edge 201 is 1.0 mm to 1.2 mm. After the cutting, a part of the can cover 200 is still stuck in the can body 100, cannot be peeled off by hand, and still needs to be clamped out with pliers. In this embodiment, because the gear disk 61 uses an inclined design of the tray gear 611 and the helical gear 612, and a round angle 613 is disposed between the tray gear 611 and the helical gear 612, during cutting, a location at which the cutting wheel 4 cuts the can cover 200 is relatively shallow, and a height of the cut edge 201 is 0.6 mm to 0.8 mm. After the cutting, the can cover 200 can be completely separated from the can body 100, which improves cutting quality.

Figure 3:
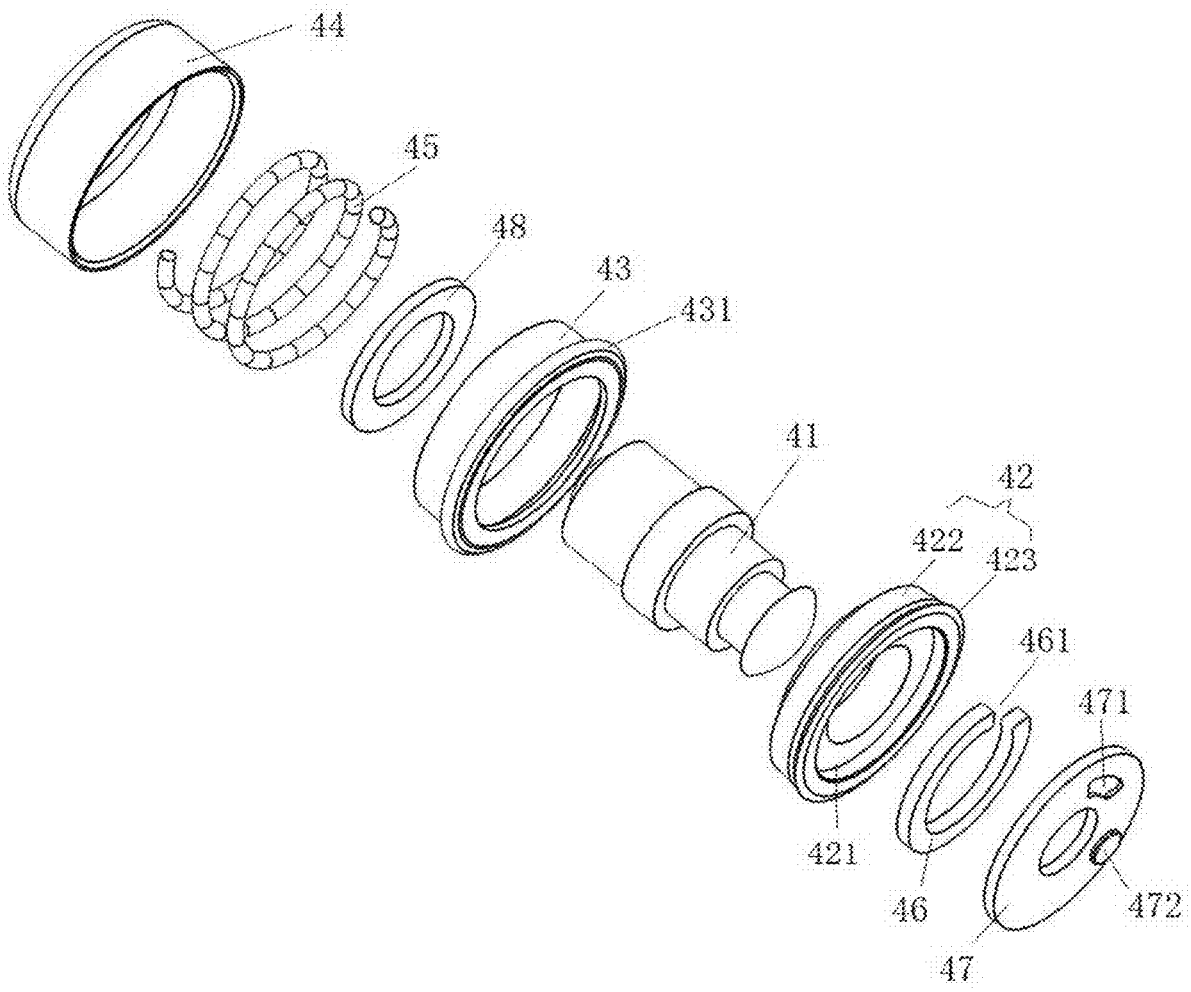
FIG. 3 is an exploded view of a cutting wheel of an edge-breaking can opener according to the present disclosure.
Figure 4:
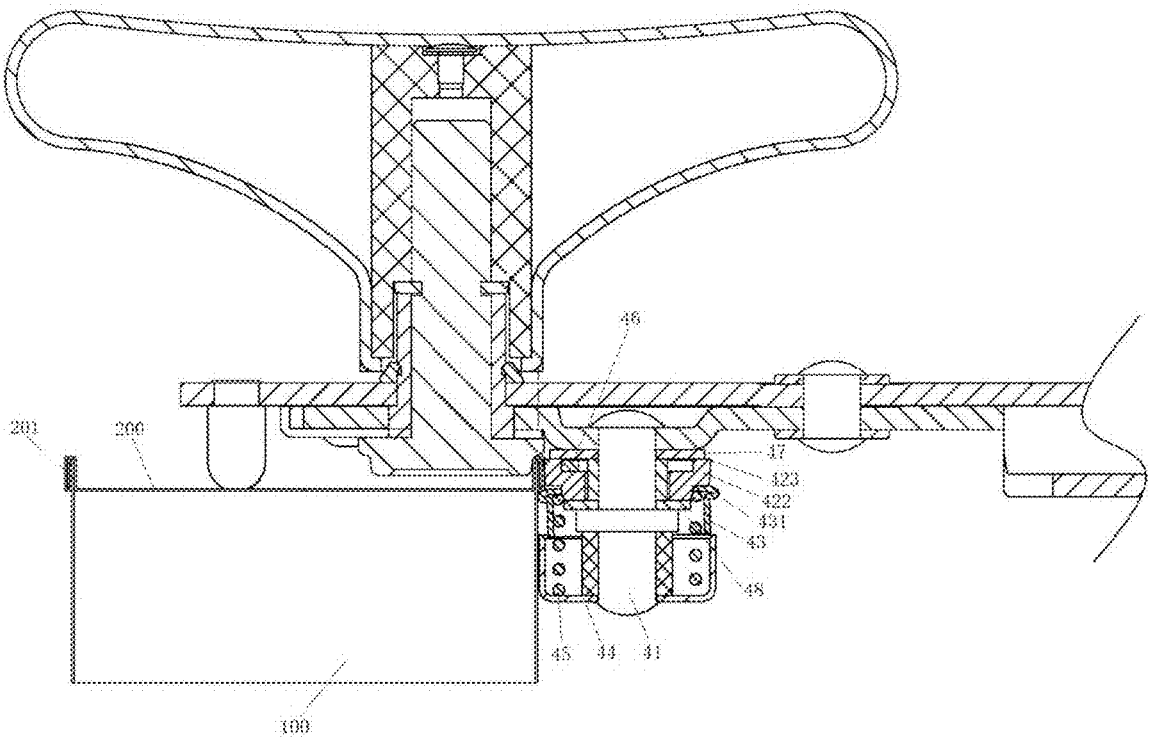
FIG. 4 is a section view of a state when an edge-breaking can opener performs cutting according to the present disclosure.
Figure 5:
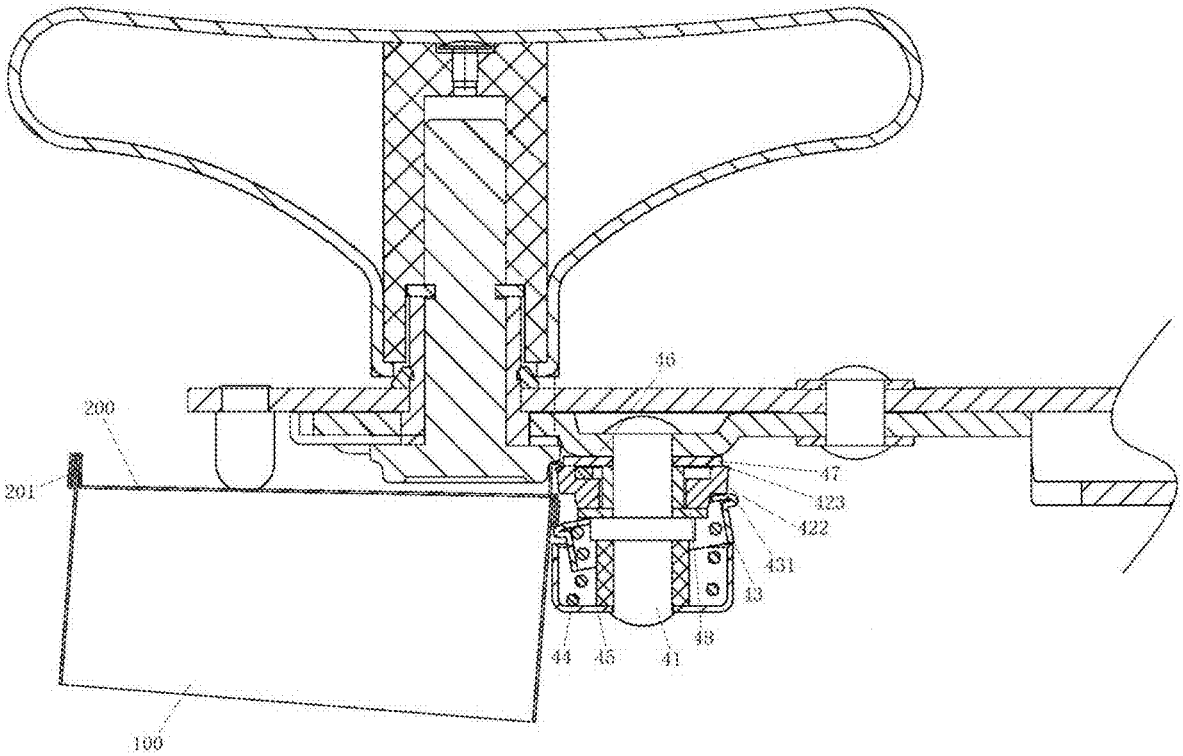
FIG. 5 is an exploded view of an activity of lifting up a can cover after an edge-breaking can opener completes cutting according to the present disclosure.

As shown in FIG. 3 to FIG. 5, the cutter wheel 42 includes an integrally formed rotating portion 422 and a cutter portion 423 protruding outwards, the cutter portion 423 is disposed at a lower portion of the cutter wheel 42, a boss portion 431 protruding outwards is disposed on the support wheel 43, and the boss portion 431 is disposed at a lower portion of the support wheel 43.

Because a protrusion portion 400 is further disposed at an upper portion of the rotating portion 422 of the existing cutter wheel 42, the cutter wheel 42 can cut the edge 201 of the can cover 200 only with a certain height. However, when a relatively high edge 201 of the can cover 200 is cut, due to a distance between the protrusion portion 400 and the cutter portion 423, the edge 201 of the can cover 200 cannot be occluded. However, in this product, the protrusion portion 400 of the rotating portion 422 is canceled, and the edge 201 of the can cover 200 is directly occluded by using the cutter portion 423 and the drive wheel 6. In addition, the support wheel 43 is elastically adjusted by using an elastic piece 45, to make a height between the cutter portion 423 and the boss portion 431 match a height of the edge 201, so that this product can cut the edge 201 of the can cover 200 with different heights. In addition, the cut can cover 200 can be further directly clamped and taken out based on a distance between the cutter portion 423 and the gear disk 61, without pliers or a hand. However, when the can cover 200 is placed, the drive wheel 6 can be directly separated from the cutting wheel 4, and the can cover 200 can directly drop, thereby improving a practical function of this product.

As shown in FIG. 3 to FIG. 5, the cutting wheel 4 further includes a cutter wheel washer 47 and a gear washer 48. The cutter wheel washer 47 is sleeved on the fixing shaft 41, and is disposed between the cutter wheel 42 and the first clamping handle 1, a spring plate stopper 471 is disposed on a surface, of the cutter wheel washer 47, adjacent to the cutter wheel 42, the spring plate stopper 471 cooperates with the opening 461, a fixing block 472 for fixing is disposed on the other surface of the cutter wheel washer 47, and the gear washer 48 is sleeved on the fixing shaft 41, and is disposed above the cutter wheel 42 and inside the support wheel 43.

The cutter wheel washer 47 and the gear washer 48 are disposed on the fixing shaft 41, and the cutter wheel washer 47 is fixed on the first clamping handle 1 by using the fixing block 472, so that when the cutter wheel 42 is rotating, the cutter wheel washer 47 does not follow the cutter wheel to rotate. The spring plate stopper 471 on the cutter wheel washer 47 acts on the spring plate 46, and the opening 464 of the spring plate 46 is stuck on the spring plate stopper 471, so that the spring plate 46 acts on the cutter wheel 42.

Figure 8:
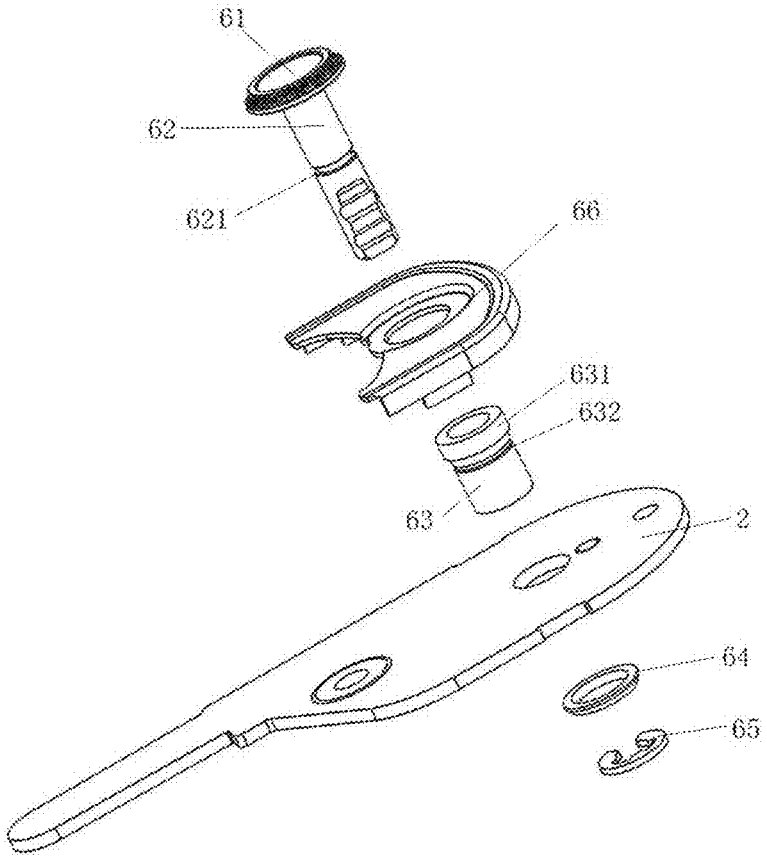
FIG. 8 is a structural exploded view of a second clamping handle and a drive wheel of an edge-breaking can opener according to the present disclosure.
Figure 9:
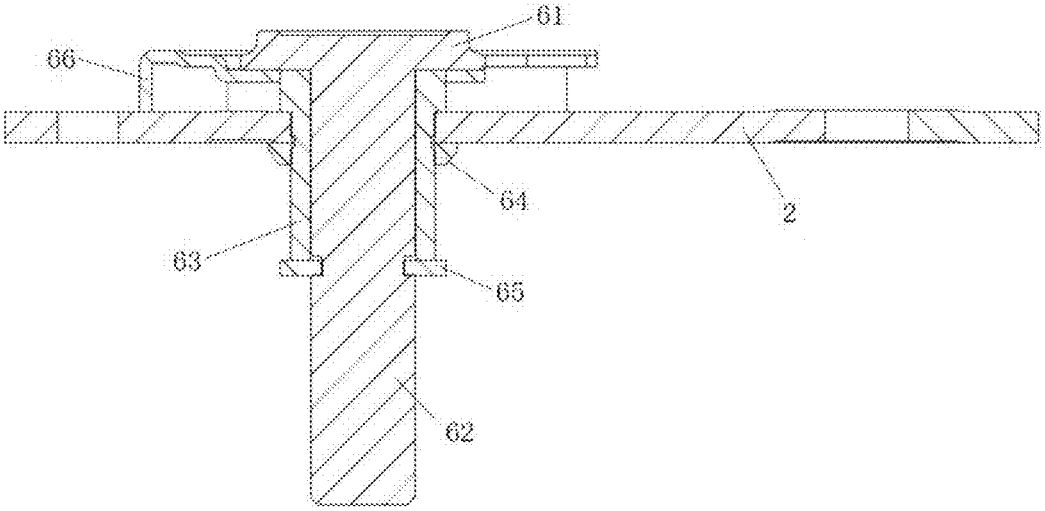
FIG. 9 is a section view of mounting a second clamping handle and a drive wheel of an edge-breaking can opener according to the present disclosure.
Figure 10:
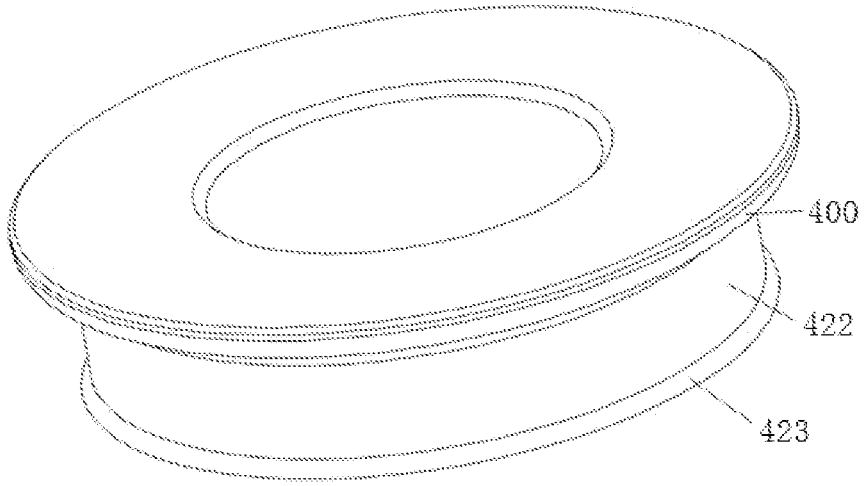
FIG. 10 is a schematic structural diagram of a cutter wheel on the market.
Figure 11:
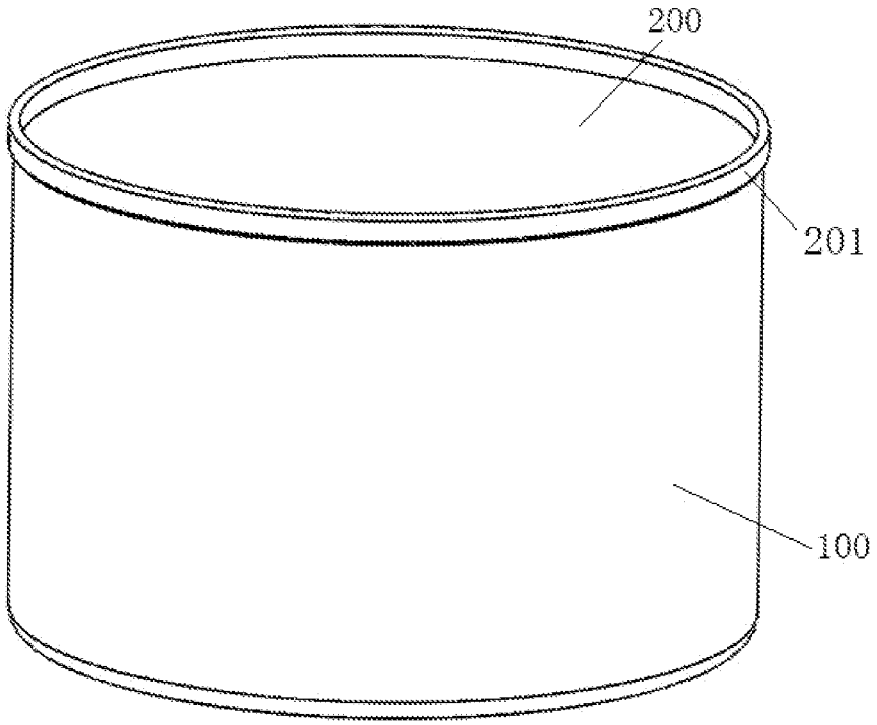
PRIOR ART FIG. 11
FIG. 11 is a schematic structural diagram of a can for an edge-breaking can opener according to the present disclosure, where as shown in the accompanying drawings: 1. first clamping handle; 2. second clamping handle; 3. rivet; 4. cutting wheel; 5. limiting groove; 6. drive wheel; 7. knob handle; 41. fixing shaft; 42. cutter wheel; 43. support wheel; 44. round cover; 45. elastic piece; 46. spring plate; 47. cutter wheel washer; 48. gear washer; 421. stepped groove; 422. rotating portion; 423. cutter portion; 431. boss portion; 461. opening; 471. spring plate stopper; 472. fixing block; 61. gear disk; 62. rotating shaft; 63. fixing sleeve; 64. rivet sleeve; 65. card; 66. surface cover; 611. tray gear; 612. helical gear; 613. round angle; 621. straight groove; 631. card; 632. oblique groove; 100. can body; 200. can cover; 201. edge; 400. protrusion portion.

As shown in FIG. 8 to FIG. 9, a fixing sleeve 63 is further disposed on the second clamping handle 2, a step 631 protruding outwards and an oblique groove 632 are separately disposed on the fixing sleeve 63, a rivet sleeve 64 is sleeved on the oblique groove 632, the fixing sleeve 63 passes through the second clamping handle 2 by using the step 631 and the rivet sleeve 64, the rotating shaft 62 passes through the fixing sleeve 63 by using the gear disk 61 and the card 65, a surface cover 66 further covers the fixing sleeve 63, the surface cover is disposed between the gear disk 61 and the first clamping handle 1, and a knob handle 7 is further disposed at the other end of the rotating shaft 62.

The fixing sleeve 63 passes through the second clamping handle 2, and comes into contact with a top surface of the second clamping handle 2 by using a lower step surface of the step 631, and acts on a bottom surface of the second clamping handle 2 by using the straight groove 632 and the rivet sleeve 64, so that the fixing sleeve 63 and the second clamping handle 2 keep a fixed connection. However, an end of the rotating shaft 62 with the gear disk 61 is disposed at one end of the fixing sleeve 63, and the other end of the rotating shaft 62 passes through the fixing sleeve 63, and is connected to the fixing sleeve 63 through cooperation between the straight groove 621 and a card 65. In addition, the knob handle 7 is disposed at the end of the rotating shaft 62. The knob handle 7 can facilitate rotating the gear disk 61. The connection between the fixing sleeve 63 and the second clamping handle 2 is made firmer through the step 631 and the rivet sleeve 64, the connection between this structure makes the costs low, and upper and lower locations of the rotating shaft 62 are not offset by using the gear disk 61 and the card 65, thereby ensuring cooperation between the gear disk 61 and the cutting wheel 4.

The cutter wheel 42 is made of a 1.4116 stainless steel material, the drive wheel 6, the cutter wheel washer 47, the gear washer 48, and the fixing sleeve 63 are all made of a 420J2 stainless steel material, and the round cover 44 is made of a 304 stainless steel material. Because 420J2 stainless steel has good wear resistance and corrosion resistance with high hardness and desirable rigidity, and German 1.4116 stainless steel has higher hardness and better toughness, a cutting service life of the cutter wheel 42 can be increased, thereby reducing abrasion wear of the cutter wheel 42, the drive wheel 6, the cutter wheel washer 47, the gear washer 48, and the fixing sleeve 63. The round cover 44 is made of 304 stainless steel. The 304 stainless steel has characteristics of desirable anti-rust performance, desirable polishing performance, and the like, can make the can opener overall beautiful, and improve use safety of the can opener, thereby increasing a service life of the edge-breaking can opener.

The foregoing shows and describes the basic principles, main features, and advantages of the present disclosure. All technicians in the industry can smoothly implement the present disclosure based on the accompanying drawings of the specification and the above description. However, all minor changes, modifications, and equivalent evolutions made to the foregoing disclosed technical content by those familiar with the field without departing from the scope of the technical solutions of the present disclosure are equivalent embodiments of the present disclosure. In addition, any changes, modifications, and evolutions of any equivalent changes made to the above embodiments based on the essential technology of the present disclosure still fall within the protection scope of the technical solutions of the present disclosure.

What is claimed is:

1. An edge-breaking can opener, comprising a first clamping handle and a second clamping handle, the first clamping handle and the second clamping handle being connected through relative rotation in a longitudinal axis by using a rivet, wherein a cutting wheel and a limiting groove are disposed on the first clamping handle, a drive wheel is disposed on the second clamping handle, the drive wheel and the cutting wheel are capable of occluding each other through the limiting groove, the cutting wheel comprises a fixing shaft, a cutter wheel, a support wheel, and a round cover, the fixing shaft incudes a first end disposed on the first clamping handle along the longitudinal axis and a second end opposite to the first end, the round cover, the support wheel, and the cutter wheel are separately sleeved on the fixing shaft from the second end to the first end, an elastic piece is disposed between the round cover and the support wheel, the cutter wheel is provided with a stepped groove, a spring plate is disposed in the stepped groove, the spring plate is sleeved on the fixing shaft, and the spring plate is provided with an opening.

2. The edge-breaking can opener according to claim 1, wherein the drive wheel comprises an integrally formed a gear disk and a rotating shaft, the rotating shaft is further provided with a straight groove, the straight groove is provided with a positioning piece, the gear disk comprises a tray gear and a helical gear, the tray gear is aslant disposed to the helical gear, and a round transitional position is provided between the tray gear and the helical gear.

3. The edge-breaking can opener according to claim 2, wherein the cutter wheel comprises an integrally formed a rotating portion and a cutter portion, the cutter portion is disposed at a lower portion of the cutter wheel, and a boss portion is disposed at a lower portion of the support wheel.

4. The edge-breaking can opener according to claim 3, wherein the cutting wheel further comprises a cutter wheel washer and a gear washer, the cutter wheel washer is sleeved on the fixing shaft, and is disposed between the cutter wheel and the first clamping handle, a spring plate stopper is disposed on a surface; of the cutter wheel washer, adjacent to the cutter wheel, the spring plate stopper cooperates with the opening, a fixing block for fixing the cutter wheel washer on the first clamping handle is disposed on the other surface of the cutter wheel washer, and the gear washer is sleeved on the fixing shaft, and is disposed above the cutter wheel and inside the support wheel.

5. The edge-breaking can opener according to claim 4, wherein a fixing sleeve is further disposed on the second clamping handle, a step protruding outward from the fixing sleeve and an oblique groove are separately disposed on the fixing sleeve, a rivet sleeve is disposed in the oblique groove, the fixing sleeve is disposed on the second clamping handle by passing through the step and the rivet sleeve, the rotating shaft passes through the fixing sleeve by using the gear disk and the positioning piece, a surface cover further covers the fixing sleeve, the surface cover is disposed between the gear disk and the first clamping handle, and a knob handle is further disposed at the other end of the rotating shaft.

6. The edge-breaking can opener according to claim 5, wherein the cutter wheel uses a 1.4116 stainless steel material, the drive wheel, the cutter wheel washer, the gear washer, and the fixing sleeve are all made of a 420J2 stainless steel material, and the round cover is made of a 304 stainless steel material.

* * * * *